United States Patent [19]

Rowney

[11] 4,088,511

[45] May 9, 1978

[54] STEELS COMBINING TOUGHNESS AND MACHINABILITY

[75] Inventor: Michael J. Rowney, Park Forest, Ill.

[73] Assignee: LaSalle Steel Company, Chicago, Ill.

[21] Appl. No.: 709,626

[22] Filed: Jul. 29, 1976

[51] Int. Cl.[2] ..... C21D 1/20

[52] U.S. Cl. ..... 148/12 F; 148/12.4; 148/36

[58] Field of Search ..... 148/12 F, 12.4, 36

[56] References Cited

U.S. PATENT DOCUMENTS

| | | | |
|---|---|---|---|
| 3,240,634 | 3/1966 | Nachtman | 148/12.4 |
| 3,340,102 | 9/1967 | Kulin et al. | 148/12 F |
| 3,423,252 | 1/1969 | Grange | 148/12.4 |
| 3,444,008 | 5/1969 | Keough | 148/12.4 |
| 3,806,378 | 4/1974 | Bramfitt et al. | 148/12 F |

*Primary Examiner*—W. Stallard

[57] ABSTRACT

A method for strengthening of carbon and low alloy steels and steels produced thereby wherein a carbon or low alloy steel is partially austenitized to produce a ferrite-austenite mixture, the resulting ferrite-austenite mixture is quenched to an intermediate temperature to render the austenite metastable, with the quenching being at a rate sufficient to avoid transformation of the austenite to ferrite and pearlite, and working the quenched steel at a temperature up to the maximum temperature at which bainite can exist whereby the ferrite-austenite mixture is converted to a ferrite-bainite mixture having high levels of machinability, strength and toughness.

54 Claims, 9 Drawing Figures

STEELS COMBINING TOUGHNESS AND MACHINABILITY

This invention is directed to strengthened steels, and particularly to steel workpieces and a method for the production of same wherein the steel workpieces are characterized by high strength combined with high toughness and good machinability.

Up to the present, there have been two procedures available to those skilled in the art in the manufacture of high strength steel parts. In one procedure, the steel is machined or formed into the desired shape, and is then heat treated, as by austenitizing, quenching and tempering, to impart the strength and toughness desired. With the second procedure, a prestrengthened steel blank is machined or formed into the desired configuration without the necessity for further heat treatment.

The second procedure outlined above frequently involves the use of prestrengthened, cold finished steel bars or rods having a metallurgical microstructure of pearlite and ferrite. A number of methods for achieving useful combinations of high strength and machinability with such steels have been described in the prior art, for example, in U.S. Pat. No. 3,908,431, 3,001,897, 2,998,336, 2,881,108, 2,767,835, 2,767,836, 2,767,837 and 2,767,838.

Methods as described in the foregoing patents have provided a significant improvement in the art, and have been shown to reduce the total energy expended in the production of machine parts.

It is necessary, in the above described methods, to preserve the pearlite-ferrite structures throughout the processing of steel bars or rods to retain a high degree of machinability. Without the desired pearlite-ferrite microstructure, the advantage of high strength combined with good machinability is lost, and there is no economic advantage in fabricating parts from a prestrengthened steel with poor machinability.

Further improvements in machinability can be realized through the use of machinability additives to the steel. Those include sulfur, lead, tellurium, selenium and bismuth. Up to the present, it has been possible to provide high levels of strength and machinability (by a combination of specially processed pearlite-ferrite microstructures and inclusions derived from machinability additives) by sacrificing some degree of toughness, that is the ability of steel to resist failure resulting from catastrophic propagation of a crack under service loads.

If, on the other hand, high toughness is a required characteristic, improved toughness can be obtained by heat treating the steel workpiece to produce a bainitic or martensitic microstructure. However, those microstructures, even when the steel contains a machinability additive, provide a substantially lower level of machinability as compared to a steel having the ferrite-pearlite microstructure. Consequently, to extend the range of applicability of prestrengthened steels to the fabrication of functional machine parts, it is desirable, and indeed necessary, to enhance the toughness of the steel at any given strength level without sacrificing machinability.

It is accordingly an object of the present invention to produce and provide a method for producing steels which combine high levels of strength and toughness with an unexpectedly high level of machinability.

It is a more specific object of the invention to produce and provide a method for producing steels having high levels of strength, toughness and machinability whereby the strength level achieved with a carbon or low alloy steel is greater than that obtainable with the same steel having a pearlite-ferrite microstructure.

These and other objects and advantages of the invention will appear more fully hereinafter, and, for purposes of illustration but not of limitation, an embodiment of the invention is shown in the accompanying drawings wherein.

The concepts of the present invention reside in the discovery that high levels of strength can be achieved with hypoeutectoid carbon and low alloy steels while retaining high levels of both toughness and machinability, when a steel workpiece is rapidly heated to a temperature above its critical temperature under carefully controlled conditions to form a ferrite-austenite phase mixture, quenched to an intermediate temperature to render the austenite metastable, worked at a temperature ranging from ambient temperature to a temperature at which bainite can exist, and slowly cooled, whereby the ferrite-austenite mixture is converted to a ferrite-bainite mixture having high levels of machinability, toughness and strength. It has been found that hypoeutectoid carbon and low alloy steels processed in that manner provide a thermomechanically worked ferrite-bainite microstructure. The resulting workpieces, produced from a given steel, provide higher levels of strength, toughness and machinability than are otherwise obtainable with the same steel over a practical range of cross sectional sizes.

Figure 1:
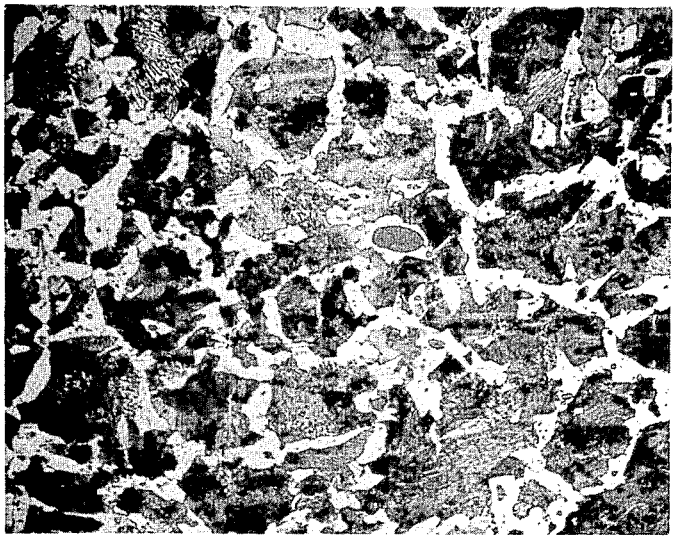
FIG. 1 is a photomicrograph of the ferrite-pearlite microstructure of hot rolled AISI/SAE grade 1144.

The method of the present invention is applicable to the processing of hypoeutectoid steels having a carbon content ranging up to 0.7% carbon by weight, and preferably containing between 0.1 to 0.7% carbon by weight. Such steels may contain relatively small quantities of the common alloying elements, such as chromium, molybdenum, nickel and manganese. By a widely used convention, a steel containing less than a total of 5% by weight of such alloying elements is referred to in the art as a "low alloy steel". Such steels used in the practice of this invention have a microstructure containing at least 10% ferrite by volume with the balance being immaterial in respect to microstructure. As supplied by steel mills in hot rolled conditions, such carbon and low alloy steels are usually characterized by a microstructure in the form of a mixture of ferrite and pearlite as shown in FIG. 1 (at 500 X). In those steels containing larger amounts of alloying elements described above, some or all of the pearlite may be replaced by bainite.

In accordance with the practice of the invention, the carbon or low alloy steel workpiece containing at least 10% ferrite in its microstructure is rapidly and uniformly heated to a temperature above its critical temperature, i.e. the temperature at which transformation of non-ferrite phases to the high temperature phase, austenite, begins. The rapid heating is carried out under close control of the time-temperature cycle to transform the non-ferrite component of the microstructure to austenite while leaving the ferrite component of the microstructure largely untransformed.

Figure 2:
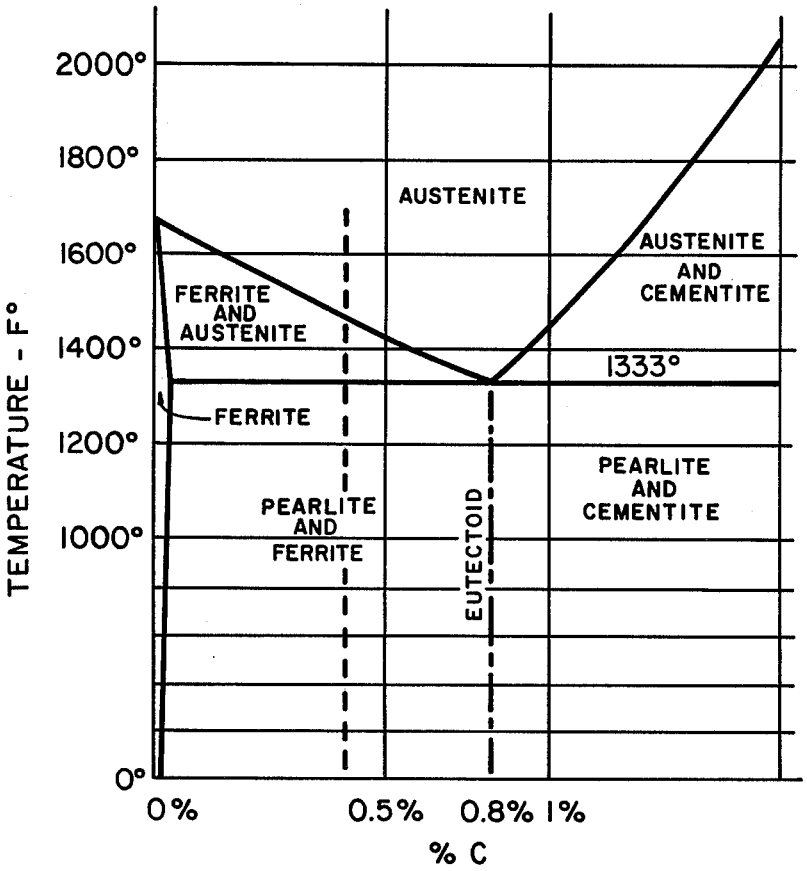
FIG. 2 is a portion of the phase diagram of the iron-carbon alloy system.

The importance of close control of the time-temperature conditions during rapid heating can be illustrated by reference to FIG. 2, a diagram showing the phases present at thermodynamic equilibrium in an iron-carbon system over a range of carbon content and a range of temperatures. In FIG. 2, the ordinate is temperature in degrees Fahrenheit and the abscissa is carbon content in percent by weight.

The dotted line extending vertically at 0.4% carbon by weight represents, by way of example, the phases present in a steel containing 0.4% carbon by weight at equilibrium for temperatures ranging from room temperature to about 1700° F. As can be seen from FIG. 2, slow heating causes transformation of the ferrite-cementite phase mixture, stable below the critical temperature line $A_1$, to begin to form austenite by a process of nucleation and growth of the new austenite phase. On further slow heating, the proportion of austenite increases, reaching 100% at the line $A_3$, the temperature above which no ferrite can exist for a given carbon level. Conventional austenitizing, as is well known to those skilled in the art, involves heating the steel to raise the temperature above the $A_3$ temperature, and allowing the austenite to homogenize by holding the steel at that temperature for extended periods of time, commonly of the order of one hour or more. In conventional austenitizing, batch or continuous furnaces in which large numbers of workpieces are heated at the same time are generally used, and the accuracy of control of temperature and uniformity of temperature throughout each steel workpiece during the heating process in the furnace are relatively poor.

Control of the austenitizing step to produce a steel having a microstructure containing a mixture of ferrite and austenite is extremely difficult, if not impossible, to accomplish practically and economically in a conventional furnace wherein a number of workpieces are heated to within the intercritical temperature range between $A_1$ and $A_3$ followed by holding at that temperature for an extended period. That is because of the inherent difficulties in control of the temperature throughout the cross section of the steel workpiece. That difficulty is compounded by the fact that the location of the phase boundaries of FIG. 2 vary considerably with the concentration of alloying elements and impurities present in the steel.

The result is that the combination of temperatures and chemistry variations described above lead to an unacceptably wide range of ferrite contents, and consequently an unacceptably wide range of mechanical properties and machinability characteristics for workpieces processed in a conventional furnace.

The concepts of the present invention involve the interruption of the transformation to austenite at a point where at least a portion of the ferrite remains throughout the heated workpiece. In the practice of the invention, partial austenitization produces a mixture of ferrite and austenite having a microstructure containing at least 10% ferrite, and preferably 10 to 30% ferrite.

In the preferred practice of this invention, each individual workpiece is heated separately, and the austenitizing process can be interrupted at precisely the same point for one workpiece as for another, notwithstanding variations in individual workpieces of carbon content, alloying element content and impurity content. The individual workpiece is rapidly heated by direct electrical resistance heating or by electrical induction heating, preferably while the temperature of the workpiece is monitored by a suitable sensing device. The rapidity of the heating process, while permitting the economic processing of large quantities of workpieces, causes the $A_1$ temperature to be displaced to a higher temperature. That, in turn, causes the austenite transformation, once it has been initiated, to proceed very rapidly.

The most preferred method for rapid heating to partially austenitize the steel workpiece and thereby form a ferrite-austenite phase mixture is by direct resistance heating. That technique, described in detail by Jones et al., U.S. Pat. No. 3,908,431, the disclosure of which is incorporated herein by reference, an electrical current is passed through the steel workpiece whereby the electrical resistance of the workpiece to the flow of current causes rapid heating throughout the entire cross section of the workpiece.

In heating according to the technique of Jones et al., the workpiece is preferably connected to a source of electric current, with the connections being made at both ends of the workpiece so that the current flows completely through the workpiece. Because the current flows uniformly through the workpiece, the temperature of the workpiece, usually in the form of a bar or rod, increases uniformly, both axially and radially. Thus, the interior as well as the exterior of the workpiece is heated simultaneously without introducing thermal strains. In contrast, in a conventional furnace, the exterior of the bars is heated much more rapidly than the interior with the result that the steel on the exterior of the bar is completely transformed to austenite while the interior of the bar may not have undergone transformation to austenite.

As indicated above, direct electrical resistance heating has the further advantage of increasing productivity since the heating step can be completed within a time ranging from one second to 10 minutes.

Control of the heating of the workpiece may be effected within narrow limits by making use of the well-known endothermic character of the austenite transformation. At the onset of the austenitic transformation, the temperature of the workpiece remains constant, or even decreases slightly for a period ranging from a few seconds to several minutes, depending somewhat upon the heating rate.

Figure 3:
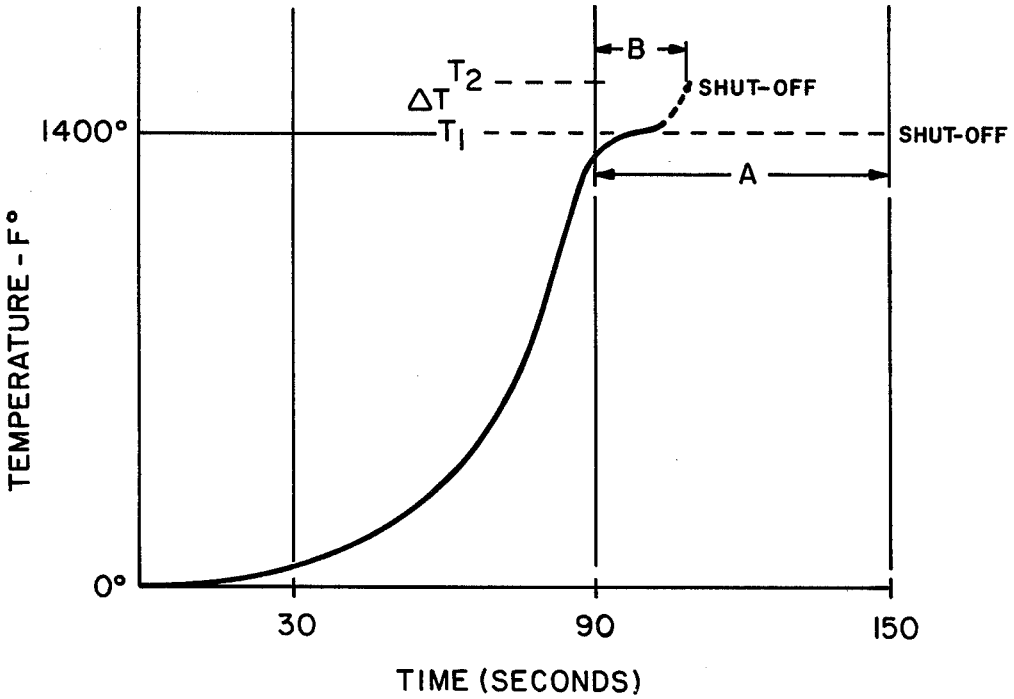
FIG. 3 is a graph of temperaure versus time of heating.

A typical heating curve for the austenitizing step used in the practice of this invention is shown in FIG. 3 of the drawing. The temperature arrest concept described above is preferably used to determine the proper point at which the partial austenitizing process is stopped by shutting off the power to the workpiece heating system. In one embodiment of the invention, it has been found that the desired microstructure can be effectively obtained by maintaining the temperature constant (by, for example, the use of a proportional temperature controller) after the temperature sensing device on the workpiece indicates that the temperature increase has been arrested. The suitable control equipment is preferably set to maintain the workpiece at the desired temperature ($T_1$ in FIG. 3) for a time (A as shown in FIG. 3), usually 90 seconds prior to shutting off the power to the heating system altogether. In this way, the temperature of the steel workpiece is not permitted to exceed the predetermined temperature of $T_1$, a temperature falling within the $A_1$ and $A_3$ phase boundaries.

In accordance with another preferred embodiment of the invention, control of the transformation can be achieved within precisely defined limits by allowing the temperature of the steel workpiece to increase by a predetermined increment $\Delta T$ above the arrest point $T_1$. After the temperature has increased by an amount equal to $\Delta T$, the power is shut off at a temperature $T_2$ and a time B after the steel workpiece has reached the arrest temperature $T_1$. That latter embodiment is also illustrated in FIG. 3 of the drawing. The value for $\Delta T$ depends somewhat on the carbon content of the steel and the rate of heating. For medium carbon steels, good results are obtained when $\Delta T$ ranges from 5° to 60° F.

The partial austenitization of the steel workpiece to produce a mixture of ferrite and austenite in the practice of this invention is one of the distinguishing features of this invention as compared to the prior art. For example, U.S. Pat. Nos. 3,340,102, 3,444,008, 3,240,634 and 3,806,378 all teach the steps of austenitizing steel and then working the austenite, either before, during or after transformation to bainite. None of the processes described by these patents, however, subjects the steel workpiece to partial austenitization since all completely austenitize so that no ferrite is present at the completion of the austenitization step. Without limiting the present invention as to theory, it is believed that the ferrite present in the steel workpiece as processed in accordance with this invention is one of many factors contributing to improved machinability and toughness to the resulting workpiece.

After the steel workpiece is partially austenitized to form a mixture of ferrite and austenite, and the power to the heating system is shut off, the workpiece is then, according to the practice of this invention, rapidly quenched by immersion in a suitable cooling medium for a predetermined time to cool the workpiece across its cross section at a rate sufficient to prevent the transformation of the austenite present to ferrite or pearlite. At the same time, the cooling of the workpiece is arrested before the temperature of the outer portions or zones of the workpiece, which cool most rapidly because they are closer to the surface of the bar, drops below that at which martensite begins to form. That temperature is referred to in the art as the $M_s$ temperature, a temperature typically in the region of 400°–600° F for a medium carbon or low alloy steel. It is an important concept of the present invention to minimize the formation of martensite in the microstructure as the presence of more than a small proportion (i.e. about 5% by volume) adversely affects machinability.

As will be appreciated by those skilled in the art, the partial austenitization step and the quench step in the practice of this invention are important interrelated variables. When the workpiece is subjected to partial austenitization, the carbon content of the steel workpiece is concentrated in the austenite phase because the maximum carbon content of ferrite is 0.02% by weight. Carbon being a highly effective hardenability element, the partial austenitization to form a mixture of ferrite and austenite, followed by quenching to prevent the formation of ferrite and pearlite, provides significantly increased hardenability without the necessity for utilizing large quantities of alloying elements for the sole purpose of increasing hardenability. That concept of the present invention provides a significant economic advantage because a large portion of the cost of steel is tied to the cost of alloying elements added thereto to improve hardenability. In addition, the maximum section size of a particular steel which can be cooled at a rate sufficiently rapid to avoid pearlite formation is greater than the maximum section size for the same steel subjected to conventional austenitization whereby the carbon content of the austenite is the same as the overall carbon content of the steel.

In the practice of the invention, the quench step should be one in which the austenite component of the partially austenitized steel is rendered metastable. As used herein, the term metastable austenite refers to austenite which is thermodynamically unstable at a given temperature, but requires the passage of time before that instability manifests itself in a change of phase. Thus, the metastable austenite formed during the quench step is one which puts the austenite in the necessary condition — thermodynamically — for transformation to bainite during subsequent working and/or cooling. The cooling rate should be such that the cooling curve for the workpiece processed in accordance with this invention fails to intersect the transformation curves necessary for formation of ferrite and pearlite until a workpiece temperature is reached at which the austenite present can be transformed to bainite.

Figure 9:
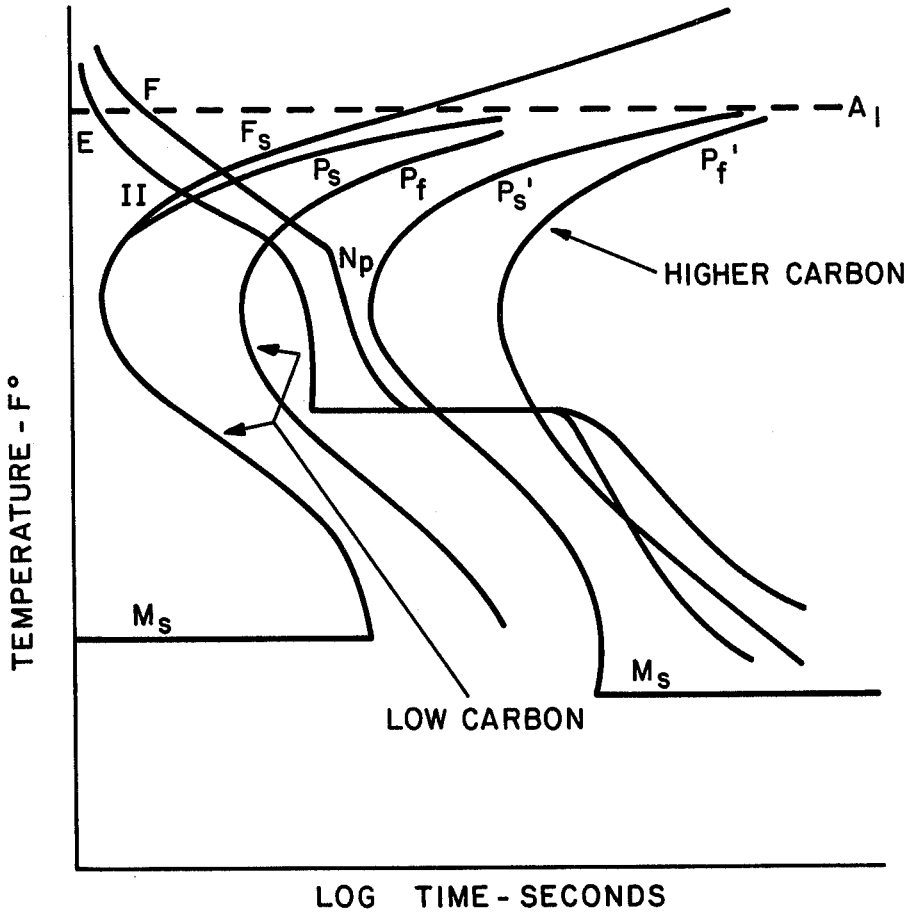
FIG. 9 is a time-temperature diagram for low and higher carbon steels, illustrating the practice of this invention.

This concept can best be illustrated by reference to FIG. 9 of the drawing, a time-temperature transformation diagram for both low and higher hardenability austenites. In FIG. 9, curves E and F represent two different cooling rates for the surface and center, respectively, of a workpiece processed in accordance with the invention. After partial austenitization, the curves proceed on cooling through a temperature $A_1$ (the temperature necessary for transformation from austenite to ferrite-pearlite under equilibrium conditions). The cooling rate continues but should avoid intersection with both curves $P_s'$, representing the start of transformation of austenite to pearlite. After the temperature of the workpiece reaches a level below that corresponding to the nose $N_p$ of the $P_s'$ curve, a temperature at which transformation of austenite to bainite can occur, the cooling is arrested, and the workpiece, as is described in greater detail hereinafter, subjected to working followed by further cooling to accelerate and extend the transformation of the austenite phase to bainite and to refine the bainite platelets thus formed, or subjected to cooling to room temperature followed by working.

The time-temperature diagram of FIG. 9 illustrates the substantial difference in results obtained in the practice of this invention when subjecting a partially austenitized workpiece to quenching, as compared to a fully austenitized workpiece. As indicated earlier, the requirement for at least 10% ferrite in the workpiece processed in accordance with this invention has the effect of concentrating most of the carbon in the austenite phase, the ferrite phase containing a maximum of 0.02% by weight carbon. For fully austenitized materials, that concentration of carbon is not achieved, and thus the carbon is distributed uniformly throughout.

The corresponding transformation of a fully austenitized workpiece to ferrite-pearlite is represented by the curves $F_s$ and $P_s$. The cooling curves E and F intersect $F_s$, $P_s$ and $P_f$, thereby resulting in the transformation of austenite to ferrite-pearlite. Under these conditions, no bainite can be formed.

The selection of the appropriate cooling rate depends upon the carbon level and alloy content of the particular steel processed. In general, the greater the carbon content of the steel, the greater is the maximum strength that can be obtained. For a steel with a given carbon and alloy content, the cooling rate of determined by time-temperature transformation diagrams of the sort shown in FIG. 9 of the drawing. Diagrams of this sort for many carbon and alloy steels are available in the literature. The quench is thus selected to provide a cooling rate fast enough to avoid the formation of ferrite-pearlite down to a temperature at which bainite can be formed but above the $M_s$ temperature, whereupon the steel is subjected to working and further cooling to accelerate and extend the transformation of austenite to bainite and to refine the bainite platelets thus formed.

The selection of the quench medium, its temperature and degree of agitation, and the time for immersion of the workpiece in the quench medium are established in accordance with well known procedures for hardenability and heat transfer. Those variables depend upon the grade of the steel and the cross sectional area of the workpiece. It is generally preferred, in the practice of this invention, to employ aqueous quench media, water, solutions of organic and/or inorganic additives in water.

Figure 5:
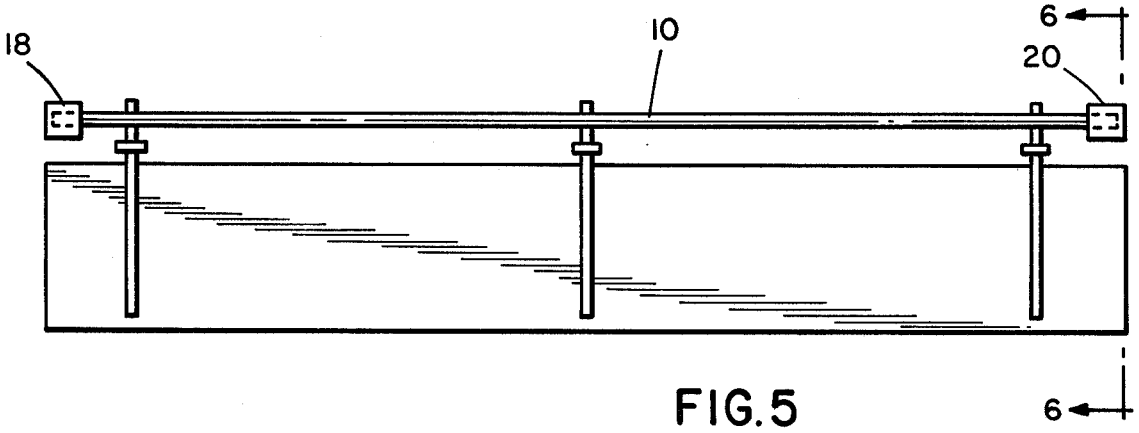
FIG. 5 is a partially schematic diagram, in elevation, of processing equipment employed in the practice of this invention.

It is desirable, in the practice of this invention, to rapidly quench the workpiece once it has been heated to the desired temperature for a partial austenitization. Various types of equipment can be used for that purpose, although it has been found that particularly good results are obtained with the equipment described in FIGS. 5 and 6 of the drawing. As shown in this figure, the steel workpiece 10 is supported by a plurality of pivotal level arms 12 above a quench tank 14 containing the quench medium 16. In the raised position as shown in FIG. 5, the workpiece 10 is in contact with a pair of electrical contacts 18 and 20 to supply a source of electrical current to heat the workpiece 10 by direct electrical resistance heating.

Figure 6:
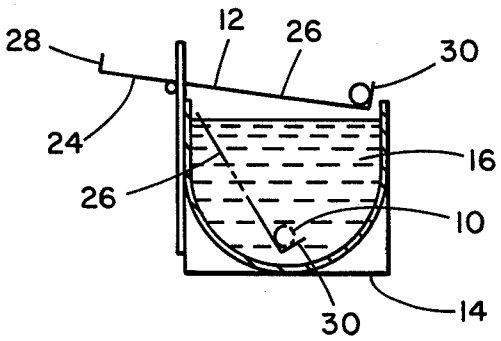
FIG. 6 is a sectional view taken along lines 5—5 in FIG. 5.

As is perhaps most clearly shown in FIG. 6 of the drawing, the lever arm 12 is pivotally mounted about a fulcrum point 22 intermediate the ends of the lever arms 12. The workpiece in the raised position is supported by a portion 24 of the lever arm 12 on one side of the fulcrum point 22. After the workpiece 10 has been heated to the desired temperature and is ready for quenching, the lever arm 12 is pivoted so that the portion 26 on the opposite side of the fulcrum point 22 becomes immersed in the quench medium 16. As the lever arm 12 is pivoted, the workpiece 10 rolls or slides along the pivotal lever arm 12 from portion 24 to portion 26 and is thereby immersed in the quench medium 16 to prevent the workpiece 10 from falling off the pivotal lever arm 12, the latter is preferably provided with stop means 28 and 30 at opposite ends of the lever arms 12. Thus, when it is desired to remove the workpiece 10 from the quench medium, the workpiece 10 is maintained in position on the portion 26 of the lever arm 12 by means of the stop means 30 as the lever arm is pivoted back to its original position to raise the workpiece from the quench medium 16.

Figure 4:
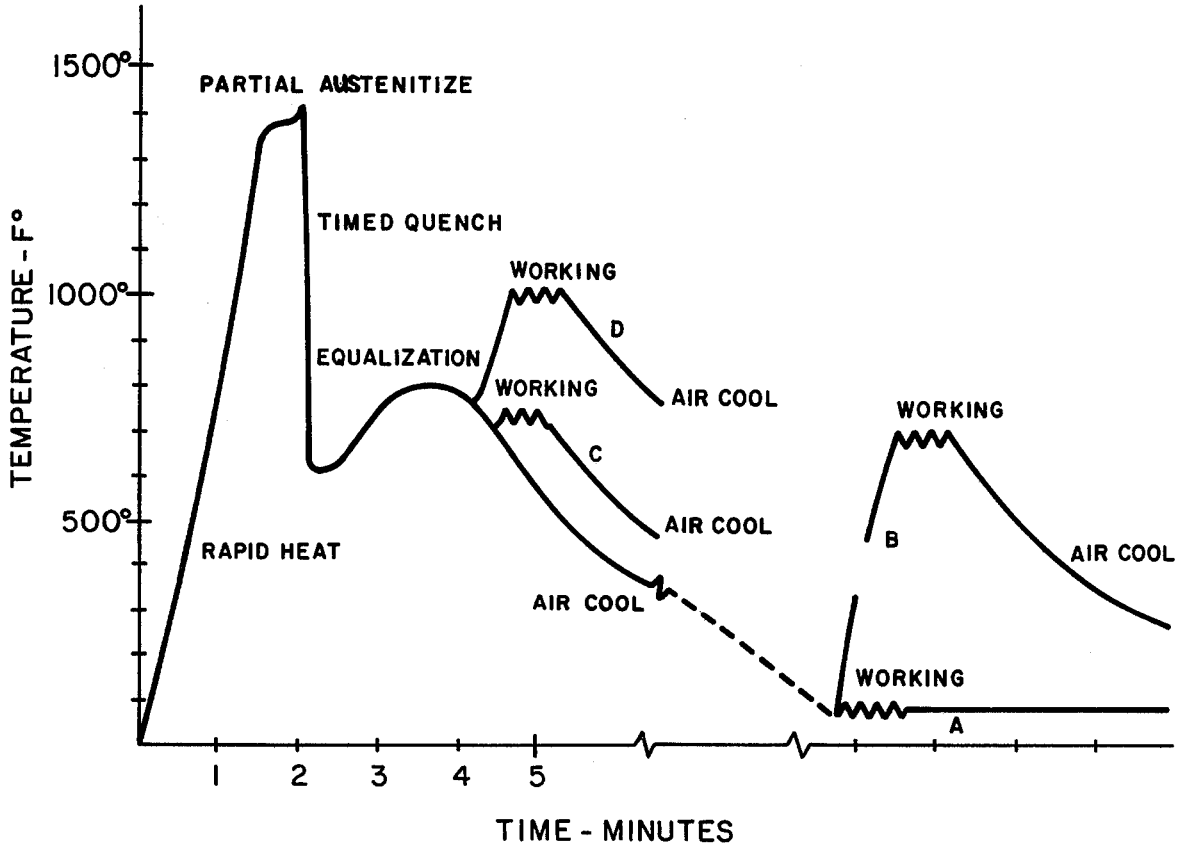
FIG. 4 is a schematic diagram of four alternative processing techniques embodying the concepts of this invention.

After the quench step, the workpiece is subjected to any one of four processing sequences in accordance with the practice of this invention. For ease of illustration, the overall processing sequences embodying the concepts of this invention are illustrated in FIG. 4, a schematic plot of temperature vs. time. In accordance with one embodiment of the invention, designated as A in FIG. 4, the workpiece, following quenching, is allowed to air cool to ambient temperature and is then subjected to mechanical working to increase the mechanical properties of the workpiece. Various types of mechanical working steps may be used in the practice of this invention, including rolling, drawing, extrusion, forging, heading, swaging, stretching or spinning. It is generally preferred to work by extrusion or drawing to achieve the desired improvements in mechanical properties. For this purpose, use can be made of a typical extrusion or drawing die of the sort well known to those skilled in the art. The preferred die for this purpose is described in U.S. Pat. No. 3,157,274, the disclosure of which is incorporated herein by reference. This particular embodiment of the invention has the advantage of separating the heat treating step from the working step, thereby facilitating high productivity in plant scale operations. As will be appreciated by those skilled in the art, the working of the workpieces can be carried out at any time, and is not limited by the rate at which the partially austenitized and quenched workpieces are supplied. On the other hand, this particular sequence has the disadvantage of providing steel workpieces having only moderately improved mechanical properties.

A variation of the foregoing embodiment, illustrated as B in FIG. 4, involves the reheating of the workpiece after air cooling to a temperature above ambient temperature but below the lower critical temperature, followed by working the steel at the elevated temperature as described above and then permitting the workpiece to air cool to ambient temperature.

Two other variations, illustrated as processes C and D in FIG. 4, may also be effected. In those processes, the workpiece, after the quench and a holding step for equalization of the temperature over the cross section of the workpiece, is either heated to a working temperature higher than that of the equalization temperature (as in process D) or cooled to a temperature below the equalization temperature (as in process C). That equalization temperature, in most instances, is a temperature ranging from 600° to 1100° F. Thereafter, the workpiece is subjected to mechanical working in accordance with one or more of the techniques described above. It has been found that, when working the workpiece after it has been cooled to a temperature in process C, the degree of strengthening is significantly greater at temperatures of the order of 600° F as compared to working at room temperature. The latter technique has the advantage of providing improved ductility or toughness. Without limiting the invention as to theory, it is believed that working in the elevated temperature range simultaneously with transformation of austenite to bainite transformation, inherently sluggish and incomplete, causes the transformation to proceed to a greater degree of completion than is achieved by transformation in the absence of a working step as in the case of process B of FIG. 4.

Only a small degree of working is necessary to achieve a substantial strengthening in the workpiece. For example, in the working operation by drawing of a bar through a die, a reduction in area or draft of a little as 10% produces significant strengthening. Higher reductions in cross sectional area produce even greater strengthening without adversely affecting ductility and toughness as would normally be effected.

It is an important concept of the present invention that the steel workpiece be subjected to working after it has been quenched to a temperature at which transformation of the austenite in the partially austenitized workpiece to bainite can occur. As has been described above, the working at this stage of the process serves to accelerate and extend the transformation of austenite to bainite which otherwise tends to be sluggish. Working at that stage also serves to refine the bainite platelets thus formed and to strengthen the ferrite present in the workpiece. Without limiting the invention as to theory, it is believed that the combination of ferrite and bainite in the finished workpiece processed in accordance with the present invention has machinability, strength and toughness characteristics which are superior to either of the ferrite and bainite components phases. The ferrite in part serves to improve machinability and toughness whereas bainite in part contributes toughness and strength. That combination of machinability, toughness and strength cannot be achieved by the prior art in which the steel is composed of ferrite and pearlite phases, or fully bainitic or fully martensitic phases. It is known, as described in U.S. Pat. No. 3,423,252, to partially austenitize a steel to form a ferrite-austenite mixture and then work the steel while that two-phase system still exists. That procedure requires that the steel be worked while in partially austenitized form (within a narrow temperature range above the $A_1$ temperature) prior to cooling to transform the austenite to bainite. That process required at least a 25% deformation, far above the working necessarily employed in the practice of this invention. Working with such large deformations at such high temperatures as required by the process described in that patent makes the overall process economically unattractive for it severely restricts the type of working which can be expeditiously carried out. For example, drawing at such temperatures is, as a practical matter, difficult, if not impossible, for lubricants capable of service under such conditions do not presently exist.

In accordance with the preferred practice of the present invention, the workpiece is preferably in the form of a steel having a repeating cross section, such as a bar or a rod, although the invention is not limited to such configurations. Preferred steels of the type described above are AISI/SAE grade 1144 and grade 1541 steels. The invention, however, is also applicable to other medium carbon and low alloy steels, and applies to processing of workpieces having non-uniform cross sections, such as a preform of a part. In any case, the process of the invention forms a semi-finished part having excellent mechanical properties and which can be subjected to machining, or forming efficiently and economically, to form a finished product.

In the preferred practice of the invention, it is possible, and sometimes desirable, to subject the workpiece, after the final cooling step to ambient temperature, to a stress relieving operation. Such stress relieving operations are themselves now conventional and are described in U.S. Pat. No. 3,908,431. It is also possible, and frequently desirable, to subject the workpiece to straightening prior to stress relieving. That technique, also well known to those skilled in the art, makes used of conventional straightening equipment generally available to the art in which the workpieces are straightened by bending the workpiece through decreasing degrees of deflection.

Figure 8:
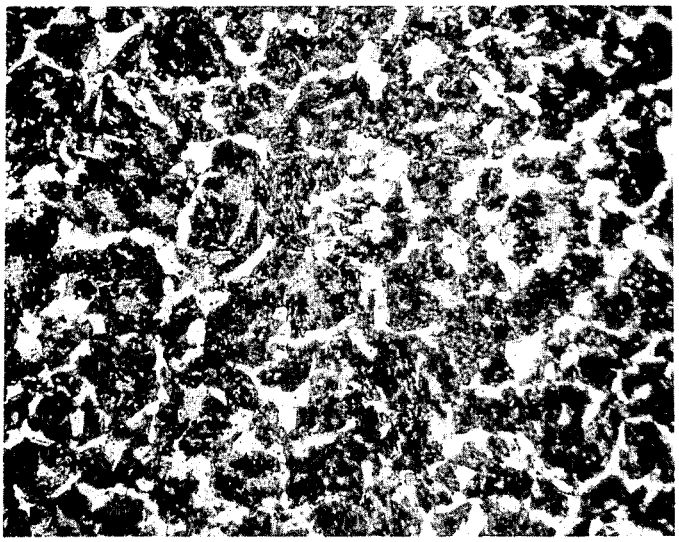
FIG. 8 is a photomicrograph of the ferrite-bainite microstructure of Grade 1144 steel processed in accordance with the invention.

The difference in the microstructure of the steels obtained in the practice of this invention as compared to their usual precursors, having a pearlite-ferrite microstructure, can be illustrated by reference to FIGS. 1 and 8 of the drawing. FIG. 1 is a photomicrograph of a pearlite-ferrite microstructure at 500 diameters. It will be observed that the light-colored dimensional network extending through the microstructure is ferrite whereas the dark areas constitute pearlite. In FIG. 8, illustrating the steels processed in accordance with the present invention and composed of ferrite and bainite, the bainite forms a particularly fine microstructure about the ferrite grains extending through the microstructure.

Having described the basic concepts of the invention, reference is now made to the following examples, which are provided by way of illustration and not by way of limitation, of the practice of the invention.

EXAMPLE 1

Twelve bars of AISI/SAE Grade 1144 steel (1 1/16 inch in diameter) were determined to have the chemistry set forth in the following table:

TABLE I

| Element | Percent by Weight |
|---|---|
| Carbon | .46 |
| Manganese | 1.65 |
| Phosphorous | .013 |
| Sulfur | .278 |
| Silicon | .31 |
| Chromium | <.05 |
| Nickel | <.05 |
| Molybdenum | <.05 |
| Copper | <.05 |
| Nitrogen | .0071 |
| Aluminum | <.005 |
| Iron | Balance |

Those bars were descaled, lime coated and pointed. Thereafter, each bar was heated individually by direct electrical resistance heating using the apparatus shown in FIG. 5 until the temperature-time indicator leveled off under constant power as illustrated in FIG. 3 at 1380° F. That temperature was then maintained constant for 90 seconds using an automatic proportional control device. Thereafter, each bar was transferred by way of the pivotal arms to an agitated water quench in which it was immersed for 6 seconds and then removed.

The surface temperature on emergence from the quench bath was then below 650° F, so the bar was reheated to 650° F.

The bar was then drawn through a die to effect a reduction in diameter of 12%. The bar was then air cooled to room temperature and straightened.

The average mechanical properties of the twelve bars before and after straightening are set forth in Table II.

TABLE II

| | 1144 partial austenitized, time quenched and warm drawn at 650° F | | 1144 hot roll warm | 4142 hot roll warm |
|---|---|---|---|---|
| | Before Straightening | After Straightening | drawn, Typical Values | drawn, Typical Values |
| Hardness, $R_c$ | 37 | 36 | 32 | 34 |
| Tensile strength, psi | 171,390 | 172,090 | 150,200 | 160,900 |
| Yield strength, psi | 164,210 | 160,390 | 140,300 | 150,400 |
| Elongation, % | 8.8 | 9.2 | 7.4 | 11.7 |
| Reduction in | | | | |

TABLE II-continued

| | 1144 partial austenitized, time quenched and warm drawn at 650° F | | 1144 hot roll warm drawn, Typical Values | 4142 hot roll warm drawn, Typical Values |
|---|---|---|---|---|
| | Before Straightening | After Straightening | | |
| Area, % | 32.8 | 33.5 | 21.5 | 41.1 |
| Room temperature Charpy impact energy, ft.-lbs. | 48.5 | — | 5 | 8 |

Table II also sets forth the mechanical properties of two commercially available steels, one made from the same grade of steel and the other produced from a higher strength, alloy grade steel by warm drawing. The data thus show the superior combination of strength and toughness (the latter property being indicated by the Charpy impact energy).

The machinability of the twelve bars processed in accordance with this invention was measured by a tool-life test and the results compared with those obtained from a standard commercial product having approximately the same strength level, warm drawn AISI/-SAE Grade 4142 steel. Those tests demonstrated that while the bars processed according to this invention had a tensile strength of about 10,000 psi higher than that of the 4142 steel, the machinabilities were very similar. The steels processed in accordance with the invention resulted in a speed for a 20-minute tool life of 185 surface ft./min. while the softer 4142 steel yielded 175 surface ft./min. Thus, the machinability tests demonstrate an unexpected combination of high strength, toughness and machinability in the steels processed in accordance with this invention.

The twelve bars processed in accordance with the invention as described above were also examined to determine the warp factor, a parameter related to the longitudinal residual stress in the bars as measured by a slitting test. The warp factor for both the unstraightened and straightened bars averaged 0.042 and 0.120, respectively. Those values represent low levels of residual stress. Together with the high level of yield strength after straightening, the warp factor indicates that the final stress relieving treatment as described is unnecessary in producing steels having superior mechanical properties.

EXAMPLE 2

This example illustrates the processing of a group of steel bars having diameters of 1 1/16 in. from two heats, A and B of Grade 1144 steel. Those bars have the chemistry set forth in Table III.

TABLE III

| Element | Heat A | Heat B |
|---|---|---|
| Carbon | .46 | .45 |
| Manganese | 1.65 | 1.54 |
| Phosphorus | .013 | .009 |
| Sulfur | .278 | .252 |
| Silicon | .31 | .20 |
| Nickel | <.05 | <.05 |
| Chromium | <.05 | .05 |
| Molybdenum | <.05 | <.05 |
| Copper | <.05 | <.05 |
| Aluminum | <.005 | <.005 |
| Nitrogen | .0071 | .0096 |
| Iron | Balance | Balance |

Bars from heats A and B were descaled, lime coated, pointed and then heated by direct electrical resistance heating to a point at which the temperature leveled off under constant power (1380° to 1390° F). The bars were held at that temperature for 90 seconds, and then were quenched for 4 seconds in an agitated water bath. Thereafter, the bars were removed from the bath, the temperature allowed to equalize across the cross section of the bars and then air-cooled to 650° F.

At that temperature, the bars were drawn through a die, air cooled, straightened, strain relieved at 950° F by direct electrical resistance heating and cooled. Thereafter, the bars were straightened, using a Medart straightening device.

The average mechanical properties for the bars from each heat are shown on Table IV.

TABLE IV

| | Heat A | Heat B |
|---|---|---|
| Hardness, $R_c$ | 32.6 | 32 |
| Tensile Strength, psi | 155,350 | 149,700 |
| Yield Strength, psi | 113,200 | 106,500 |
| Elongation, % | 11.8 | 12.2 |
| Reduction in Area, % | 38.8 | 38.4 |
| Room Temperature Charpy Impact Energy, ft.-lbs. | 47.2 | 79.9 |

Bars from both heats were than used in a production scale machinability test in a 1 in. RAN 6-spindle Acme-Gridley screw machine. That device measures the part growth as a function of the number of the parts produced to indicate tool wear rate.

Figure 7:
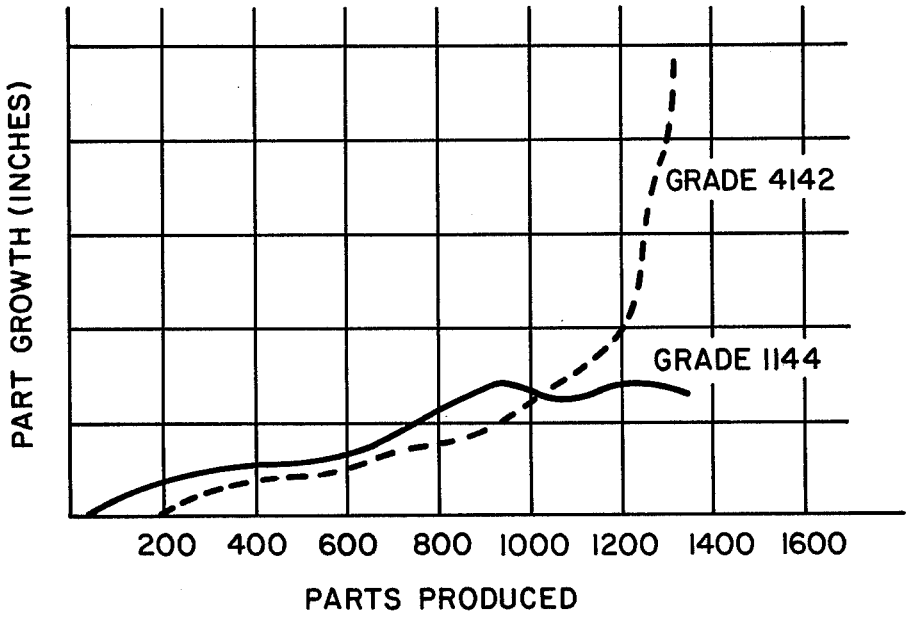
FIG. 7 is a graphical representation of part growth versus number of parts produced in a machinability test.

FIG. 7 of the drawing illustrates the tool wear rate (by the solid line) in comparison to that of the standard commercial product, warm drawn Grade 4142 steel having the mechanical properties set forth in Table II above. As can be seen from this figure, the tool wear rate of the Grade 1144 steel processed in accordance with this invention is comparable to the lowest tool wear rates recorded for the Grade 4142 steel. Moreover, the data show that the catastrophic tool failure usually occurring with Grade 4142 steel at about 1200 parts produced for the given feeds and speeds did not occur with the Grade 1144 steel processed in accordance with the invention.

EXAMPLE 3

A group of 12 bars of Grade 1144 steel having a diameter of 1 1/16 in. was determined to have a ladle analysis as follows:

| | |
|---|---|
| Carbon | .42% |
| Manganese | 1.5 % |
| Phosphorus | .017% |
| Sulfur | .23% |
| Iron and usual impurities | Balance |

Those bars were descaled, lime coated, pointed and heated individually by direct electrical resistance heating to a temperature of 35° F above the temperature arrest point. Thereafter, the bars were time quenched for 5.2 seconds in an agitated water bath, after which they were equalized, cooled to 650° F and drawn through a die to effect a 12% reduction in area. The resulting bars were then air cooled, straightened and finally strain relieved by direct electrical resistance heating at 800° F.

That processing resulted in bars with a ferrite-bainite microstructure throughout the cross section. The bars are identified as Group A.

A further group of 10 bars from the same heat and having the same diameter was heated to a temperature of 160° F above the arrest temperature to effect complete austenitization. The bars were then quenched for 5.2 seconds in an agitated water bath, equalized, air cooled to 650° F and drawn through a die to effect a 12% reduction in area. Then, the bars are straightened and strain relieved at 750° F by direct electrical resistance heating.

Those bars identified as Group B (700) had a predominantly bainitic microstructure, except that, due to the lower hardenability resulting from full austenitizing of Group A, the center portion of the cross section of the bars contained a substantial proportion of pearlite.

The mean mechanical properties of the Group A and the Group B (700) bars is set forth in Table V below.

TABLE V

| | Group A | Group B (700) |
|---|---|---|
| Tensile strength, psi | 166,300 | 167,800 |
| Yield Strength, psi | 158,100 | 163,100 |
| Elongation, % | 7.7 | 8.7 |
| Reduction of Area, % | 26.9 | 33.8 |

The machinability of the above bars were then compared in a production-scale test using a 1 in. RAN Acme-Gridley 6-spindle automatic screw machine. (The speed and feed selected for the test was that used for the processing of commercial Grade 4142 described above.) The Group A bars exhibited outstanding machinability showing a part growth (from tool wear) of only 0.0025 in. after producing 1500 parts. In contrast, with Grade 4142, the test resulted in catastrophic tool failure after about 1200 parts. In addition, the machinability test which included drilling did not necessitate the replacement of drills used on the Grade 1144 steel processed in accordance with this invention (Group A). In the processing of Grade 4142, it is normal practice to replace at least one drill before 1200 parts are produced.

The Group B(700) bars produced by complete austenitization were tested under the same conditions. Those steels caused so much chatter that the test had to be stopped. It was concluded that the behavior resulted from excessive surface hardness ($R_c$ of 42 as opposed to $R_c$ of 36 for the Group A bars), and the Group B(700) bars were subjected to a second strain relieving operation at 950° F to reduce the hardness, followed by a straightening operation. The resulting tensile properties are shown in Table VI.

TABLE VI

| | Group B(950) |
|---|---|
| Tensile strength, psi | 156,700 |
| Yield strength, psi | 144,400 |
| Elongation, % | 11.9 |
| Reduction of Area, % | 35.9 |

The foregoing data show that the tensile strength of the Group B(950) bars was 10,000 psi less than that for the Group A bars processed in accordance with the practice of this invention.

The screw machine test for machinability was then repeated for the Group B(950) bars. It was found that whereas the form tool wear, as measured by growth in part size, was not significantly greater than that for the Group A bars, there was excessive wear on both drill and cutoff tool during machining of the Group B (950) bars.

The toughness of the bars from Group A and Group B(700) was determined by measuring the Charpy impact energy over a range of temperatures. It was found that, while the ductile-brittle transition temperatures of the bars from the Group A and Group B(700) bars were the same (about 75° F), the maximum impact energy, referred to in the art as the upper shelf energy, was greater for the Group A bars than that for the Group B(700) bars (40 ft.-lbs. compared to 25 ft.-lbs.).

Thus, the tests demonstrate that the bars of Group A having a ferrite-bainite microstructure were significantly superior in terms of both machinability and toughness as compared to bainitic bars of the same heat for a steel Grade 1144.

EXAMPLE 4

In this example, 4 cold drawn bars having a diameter of 1 in. of Grade 1541 steel were determined to have a ladle analysis as follows:

| | |
|---|---|
| Carbon | .41 |
| Manganese | 1.48 |
| Sulfur | 0.025 |
| Iron and usual impurities | Balance |

Those bars were fully austenitized by direct electrical resistance heating at 1800° F, and then quenched in an agitated water bath to ambient temperatures to form a martensitic microstructure.

Individual bars were then tempered by direct electrical resistance heating to temperatures of 800°, 900°, 1000° and 1100° F. Tensile and Charpy impact test specimens were machined from each bar and tested, with the results being set forth in Table VII. A series of bars of the same grade having the same diameter were descaled, lime coated, pointed and partially austenitized by rapid heating using direct electrical resistance heating to a temperature of 35° F above the temperature arrest point to form a ferrite-austenite microstructure. The bars were then quenched for 5.2 seconds in an agitated water bath and the temperature equalized across the cross section of the bar by holding in air for a few minutes.

Individual bars were then heated or cooled to a series of temperatures of 650°, 800° and 900° F, at which each was drawn through a die to effect a reduction in area of about 12%. Thereafter, the bars were air cooled to form a thermomechanically worked ferrite-bainite microstructure.

The die-drawn bars were then cut into shorter lengths and strain relieved by direct electrical resistance heating at temperatures of 800°, 850° and 900° F. Tensile and Charpy impact test specimens were machined from each bar and tested, with the results being set forth in Table VII.

TABLE VII

| FERRITE - BAINITE | | | | | | | QUENCHED AND TEMPERED | | | | | |
|---|---|---|---|---|---|---|---|---|---|---|---|---|
| Die-Drawing Temp., ° F | Strain Relieving Temp. ° F | Tensile Strength psi | Yield Strength psi | Elong-ation, % | Red. in Area, % | Room Temp. Charpy Impact Energy, ft.-lb. | Temper-ing Temp. ° F | Tensile Strength psi | Yield Strength psi | Elong-ation, % | Red. in Area, % | Room Temp. Charpy Impact Energy ft.-lb. |
| 650 | 800 | 192,200 | 191,700 | 13.0 | 57.0 | 23 | 800 | 193,700 | 173,700 | 12.5 | 43.1 | 14 |
| 650 | 850 | 180,200 | 179,700 | 15.0 | 56.0 | 32 | 900 | 178,200 | 164,800 | 13.0 | 50.9 | 32 |
| 800 | 900 | 155,300 | 146,800 | 17.0 | 39.0 | 54 | 1000 | 156,900 | 147,400 | 17.0 | 56.1 | 45 |
| 900 | 900 | 145,300 | 131,800 | 17.0 | 44.0 | 68 | 1100 | 143,200 | 132,800 | 18.0 | 56.7 | 50 |

As can be seen from Table VII, at equal tensile strength levels, the ferrite-bainite bars exhibit higher yield strengths, comparable percent elongation values and somewhat inferior reduction in area values while exhibiting equal or greater room temperature Charpy impact energy values as compared to the quenched and tempered martensitic microstructure.

During machining of the tensile specimens, it was found that the ferrite-bainite bars machined well with good chip formation. In contrast, machining of the tempered martensitic bars caused so much tool chatter that the feed and speed had to be drastically reduced and the carbide tool inserts had to be frequently replaced.

Thus, the data show that the ferrite-bainite bars obtained in the practice of this invention exhibit superior toughness and machinability combinations as compared to tempered martensitic bars (quenched and tempered) produced from the same steel at the same tensile strength levels.

EXAMPLE 5

Eight bars, having a diameter of 1 1/16 in., of hot rolled Grade 1144 steel were taken from each of two heats, X and Y.

Of the total of 16 bars, pairs of bars from each heat were subjected to one of four different processing schedules, A, B, C and D. The initial step in each processing scheduling was the same, namely rapidly heating by direct electrical resistance heating to a temperature 35° F above the temperature arrest point for the bars, followed by quenching for 5.2 seconds in an agitated water bath.

Thereafter, the four processing schedules were as follows:

A — The bars were air cooled to ambient temperature (70° F), drawn through a die to effect a reduction in diameter of 1/16 in.

B — The bars were air cooled to ambient temperature, drawn through a die to effect a reduction in diameter of ⅛ in.

C — The surface and interior temperatures of the bars were allowed to equalize, and the bars were then air cooled to 650° F; followed by drawing through a die to effect a reduction in diameter of 1/16 in. followed by air cooling to ambient temperature.

D — The bars were allowed to equalize and air cool to 650° F, and were then drawn through a die to effect a reduction in diameter of ⅛ in. followed by air cooling to ambient temperature.

The processing of the 16 bars was effected in a random sequence. Test specimens were prepared and tested from all 16 bars and the results shown in Table VIII.

TABLE VIII

| Heat | Process Schedule | Die-Drawing Temp., ° F | Draft, in. | Tensile Strength, psi | Yield Strength, psi | Elon-gation,% | Red. in Area, % |
|---|---|---|---|---|---|---|---|
| X | A | 70 | 1/16 | 158,800 | 155,800 | 7.5 | 33.5 |
| | | | | 154,300 | 149,800 | 8.5 | 37.9 |
| X | B | 70 | 1/8 | 138,900 | 138,900 | 8.5 | 38.8 |
| | | | | 143,700 | 143,200 | 9.0 | 31.5 |
| X | C | 650 | 1/16 | 170,900 | 170,400 | 5.0 | 22.4 |
| | | | | 171,900 | 171,900 | 5.0 | 22.8 |
| X | D | 650 | 1/8 | 168,400 | 168,400 | 7.5 | 30.6 |
| | | | | 168,700 | 167,700 | 7.5 | 32.5 |
| Y | A | 70 | 1/16 | 174,200 | 171,200 | 9.0 | 39.4 |
| | | | | 167,400 | 166,900 | 9.0 | 40.3 |
| Y | B | 70 | 1/8 | 171,200 | 171,200 | 8.5 | 36.0 |
| | | | | 176,700 | 176,700 | 8.5 | 34.8 |
| Y | C | 650 | 1/16 | 178,200 | 178,200 | 7.5 | 31.6 |
| | | | | 179,500 | 178,200 | 7.5 | 32.1 |
| Y | D | 650 | 1/8 | 183,700 | 182,700 | 9.0 | 36.0 |
| | | | | 174,200 | 184,200 | 8.5 | 32.8 |

The results demonstrate the good reproducibility of the processing of this invention. The data indicate that unusually good combinations of strength and ductility may also be obtained by cold working a steel with a ferrite-bainite microstructure (process A of FIG. 4).

It will be understood that various changes and modifications can be made in the details of procedure, operation and use, without departing from the spirit of the invention, as defined in the following claims.

I claim:

1. A method for the strengthening of carbon and low alloy steels comprising (1) partially austenitizing a carbon or low alloy steel to produce a ferrite-austenite mixture, (2) quenching the partially austenitized steel to an intermediate temperature above the $M_s$ temperature for the steel at a rate sufficient to avoid transformation of the austenite to ferrite and pearlite, and (3) working the quenched steel at a temperature ranging from ambient temperature up to a temperature at which bainite can exist whereby the ferrite-austenite mixture is converted to a ferrite-bainite mixture having high levels of machinability, strength and toughness.

2. A method as defined in claim 1 wherein the steel contains at least 10% by volume ferrite.

3. A method as defined in claim 1 wherein the steel is a hypoeutectoid carbon steel.

4. A method as defined in claim 1 wherein the steel is a carbon steel containing from 0.1 to 0.7% carbon.

5. A method as defined in claim 1 wherein the steel is a low alloy steel containing less than 5% total alloying elements by weight.

6. A method as defined in claim 1 wherein the steel partially austenitized is a steel formed of ferrite and pearlite.

7. A method as defined in claim 1 wherein the steel is an AISI/SAE Grade 1144 steel.

8. A method as defined in claim 1 wherein the steel is partially austenitized at a temperature ranging from about 1340° to 1680° F.

9. A method as defined in claim 1 wherein the steel is partially austenitized by rapid heating by passing an electric current through the steel.

10. A method as defined in claim 1 wherein the steel is partially austenitized by heating in less than 10 minutes.

11. A method as defined in claim 9 wherein the electric current is passed through the steel to heat the steel until the increase in temperature of the steel ceases, and then the amount of current passed through the steel is adjusted to maintain the steel at a constant temperature.

12. A method as defined in claim 9 wherein the electric current is passed through the steel until the increase in temperature of the steel ceases, and then the flow of electric current is stopped after a pre-determined temperature is reached and a pre-determined time has passed from the time when the increase in temperature of the steel ceased.

13. A carbon or low alloy steel produced by the method of claim 1.

14. A steel as defined in claim 13 wherein the steel is a carbon steel containing carbon up to 0.7% by weight.

15. A steel as defined in claim 13 wherein the steel is a low alloy steel containing less than 5% by weight alloying elements.

16. A steel as defined in claim 15 wherein the alloying element is selected from the group consisting of chromium, molybdenum, nickel, manganese and combinations thereof.

17. A method for the strengthening of carbon and low alloy steels comprising:

(1) partially austenitizing a hypoeutectoid carbon steel or low alloy steel by rapid heating to produce a ferrite-austenite mixture, (2) quenching the partially austenitized steel to an intermediate temperature above the $M_s$ temperature for the steel at a rate sufficient to avoid transformation of the austenite to ferrite and pearlite, (3) working the quenched steel at a temperature ranging from ambient temperature up to a temperature at which bainite can exist, and (4) cooling the steel whereby the ferrite-austenite mixture is converted to a ferrite-bainite mixture, with such conversion being accelerated and extended during working and/or cooling.

18. A method as defined in claim 17 wherein the steel contains at least 10% by volume ferrite.

19. A method as defined in claim 17 wherein the steel is a carbon steel containing from 0.1 to 0.7% carbon.

20. A method as defined in claim 17 wherein the steel is a low alloy steel containing less than 5% total alloying elements by weight.

21. A method as defined in claim 17 wherein the steel partially austenitized is a steel formed of ferrite and pearlite.

22. A method as defined in claim 17 wherein the steel is an AISI/SAE Grade 1144 steel.

23. A method as defined in claim 17 wherein the steel is partially austenitized by rapid heating by passing an electric current through the steel.

24. A method as defined in claim 23 wherein the electric current is passed through the steel to heat the steel until the increase in temperature of the steel ceases, and then the amount of current passed through the steel is adjusted to maintain the steel at a constant temperature.

25. A method as defined in claim 23 wherein the electric current is passed through the steel until the increase in temperature of the steel ceases, and then the flow of electric current is stopped after a pre-determined temperature is reached and a pre-determined time has passed from the time when the increase in temperature of the steel ceased.

26. A method as defined in claim 17 wherein the steel is subjected to working by advancing through a die.

27. A method as defined in claim 17 wherein the steel is subjected to working at a temperature above ambient temperature.

28. A method as defined in claim 17 wherein the steel is subjected to working at a temperature ranging from 600° to 1100° F.

29. A method as defined in claim 17 which includes the step of strain relieving the steel.

30. A method as defined in claim 17 which includes the step of straightening the steel.

31. A method for the strengthening of carbon and low alloy steels comprising:

(1) partially austenitizing a hypoeutectoid carbon or low alloy steel by rapid heating in less than ten minutes to produce a ferrite-austenite mixture.

(2) quenching the partially austenitized steel to an intermediate temperature above the $M_s$ temperature for the steel at a rate sufficient to avoid transformation of the austenite to ferrite and pearlite, and (3) working the quenched steel at a temperature ranging from ambient temperature up to a temperature at which bainite can exist whereby the ferrite-austenite mixture is converted to a ferrite-bainite mixture having high levels of machinability, strength and toughness.

32. A method as defined in claim 31 wherein the steel is cooled to ambient temperature after quenching, and is subjected to working at ambient temperature.

33. A method as defined in claim 31 wherein the steel is cooled to room temperature after quenching, reheated to an elevated temperature above ambient temperature but below the critical temperature and subjected to working at said elevated temperature.

34. A method as defined in claim 31 wherein the steel is held after quenching for a time sufficient to enable the temperature of the steel to equalize over the cross section thereof, cooled to a temperature below the equalization temperature and subjected to working at a temperature above ambient temperature but below the equalization temperature.

35. A method as defined in claim 34 wherein the equalization temperature ranges from 600° to 1100° F.

36. A method as defined in claim 31 wherein the steel is held after quenching for a time sufficient for the temperature of the steel to equalize over the cross section thereof, heated to a temperature above the equalization temperature and subjected to working while at a temperature above the equalization temperature.

37. A method as defined in claim 36 wherein the equalization temperature ranges from 600° to 1100° F.

38. A method as defined in claim 31 wherein the steel contains at least 10% by volume ferrite.

39. A method as defined in claim 31 wherein the steel is an AISI/SAE Grade 1144 steel.

40. A method as defined in claim 31 wherein the steel is partially austenitized at a temperature ranging from about 1340° to 1680° F.

41. A steel produced by the method defined in claim 31.

42. A steel produced by the method defined in claim 17.

43. A method for the strengthening of carbon and low alloy steels comprising:

(1) partially austenitizing a hypoeutectoid carbon or low alloy steel by passing an electric current through the steel to rapidly heat the steel in less than ten minutes and produce a ferrite-austenite mixture, (2) quenching the partially austenitized steel to an intermediate temperature above the $M_s$ temperature for the steel at a rate sufficient to avoid transformation of the austenite to ferrite and pearlite, and (3) working the quenched steel at a temperature ranging from ambient temperature up to a temperature at which bainite can exist whereby the ferrite-austenite mixture is converted to a ferrite-bainite mixture having high levels of machinability, strength and toughness.

44. A method as defined in claim 43 wherein the steel is cooled to ambient temperature after quenching, and is subjected to working at ambient temperature.

45. A method as defined in claim 43 wherein the steel is cooled to room temperature after quenching, reheated to an elevated temperature above ambient temperature but below the critical temperature and subjected to working at said elevated temperature.

46. A method as defined in claim 43 wherein the steel is held after quenching for a time sufficient to enable the temperature of the steel to equalize over the cross section thereof, cooled to a temperature below the equalization temperature and subjected to working at a temperature above ambient temperature but below the equalization temperature.

47. A method as defined in claim 46 wherein the equalization temperature ranges from 600° to 1100° F.

48. A method as defined in claim 43 wherein the steel is held after quenching for a time sufficient for the temperature of the steel to equalize over the cross section thereof, heated to a temperature above the equalization temperature and subjected to working while at a temperature above the equalization temperature.

49. A method as defined in claim 43 wherein the steel contains at least 10% by volume ferrite.

50. A method as defined in claim 43 wherein the steel is a low alloy steel containing less than 5% total alloying elements by weight.

51. A method as defined in claim 43 wherein the steel is an AISI/SAE Grade 1144 steel.

52. A method as defined in claim 43 wherein the electric current is passed through the steel to heat the steel until the increase in temperature of the steel ceases, and then the amount of current passed through the steel is adjusted to maintain the steel at a constant temperature.

53. A method as defined in claim 43 wherein the electric current is passed through the steel until the increase in temperature of the steel ceases, and then the flow of electric current is stopped after a pre-determined temperature is reached and a pre-determined time has passed from the time when the increase in temperature of the steel ceased.

54. A steel produced by the method defined in claim 43.

* * * * *